US007001107B2

(12) United States Patent
Matsuoka

(10) Patent No.: US 7,001,107 B2
(45) Date of Patent: Feb. 21, 2006

(54) AIR CYLINDER FASTENING DEVICE

(75) Inventor: Mitsushiro Matsuoka, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/950,571

(22) Filed: Sep. 28, 2004

(65) Prior Publication Data

US 2005/0084335 A1 Apr. 21, 2005

(30) Foreign Application Priority Data

Oct. 6, 2003 (JP) ..... 2003/347475

(51) Int. Cl.
*B63C 11/02* (2006.01)
*A44B 11/25* (2006.01)

(52) U.S. Cl. ..... 405/186; 24/179

(58) Field of Classification Search ..... 405/185, 405/186; 248/74.3; 24/279, 280
See application file for complete search history.

(56) References Cited

U.S. PATENT DOCUMENTS 2,403,449 A * 7/1946 Meyer et al. ..... 24/279
3,540,758 A * 11/1970 Torres ..... 285/233
3,891,131 A * 6/1975 Tabata ..... 224/628
5,567,084 A * 10/1996 Oliver ..... 405/186
5,626,439 A * 5/1997 Rowlands ..... 405/186
5,761,774 A * 6/1998 Champi ..... 24/274 R
6,409,429 B1 * 6/2002 Belloni ..... 405/186
2003/0084557 A1 * 5/2003 Whitehead ..... 29/281.5
2004/0068847 A1 * 4/2004 Belisle et al. ..... 24/279
2004/0261228 A1 * 12/2004 Steadman ..... 24/279

FOREIGN PATENT DOCUMENTS

IL 153136 * 11/2002
JP 2001-254706 9/2001

* cited by examiner

*Primary Examiner*—Thomas B. Will
*Assistant Examiner*—Tara L. Mayo
(74) *Attorney, Agent, or Firm*—Clark & Brody

(57) ABSTRACT

An air cylinder fastening device has a belt and structure for belt tightening. Belt tightening structure is attached to each of the longitudinally opposite ends of the belt, and comprises first and second slider members opposed to each other in a circumferential direction of the air cylinder and a coupler member adapted to move these members close to or apart from each other. The coupler member comprises a front segment fixed to a rotor of the first slider member, a rear segment extending from the front segment toward the second slider member, a threaded part of the rear segment extending outward through a rotor of the second slider member, a control knob screwed on the threaded part and a spring interposed between the rotor and the control knob.

4 Claims, 5 Drawing Sheets

AIR CYLINDER FASTENING DEVICE

BACKGROUND OF THE INVENTION

The present invention relates to a device adapted to fasten an air cylinder used by a diver or a swimmer to a harness.

An air cylinder fastening device disclosed in Japanese Unexamined Patent Application Publication No. 2001-254706 (Citation) includes a drum to take up a belt so that the belt reeled out from the drum and put around the cylinder is tightened by rotating worm gears with a control handle in hand.

The air cylinder fastening device disclosed in Citation is certainly advantageous in that cooperation of the drum with the worm gears alleviates a force required to tighten the belt. However, such arrangement tends to make the device bulky. In addition, the movable part comprising the worm gears is apt to be affected even by fine dusts contained in the supplied air.

SUMMARY OF THE INVENTION

In view of the problem as has been described above, it is an object of the present invention to provide an air cylinder fastening device including a movable part serving to tighten a belt but reliably functioning substantially without being affected by the presence of fine dust or the like possibly contained in the supplied air.

The object set forth above is achieved, according to the present invention, by an air cylinder fastening device comprising a belt adapted for releasably fastening the air cylinder to a harness used to carry the air cylinder on a user's back and tightening means for the belt.

The air cylinder fastening device further comprises the tightening means comprising a first and second slider members opposed to each other on a peripheral surface of the air cylinder as viewed in a circumferential direction of the air cylinder and being slidable in the circumferential direction and a coupler member extending between the first and second slider members and adapted to bring these two slider members get nearer to or draw off from each other, each of the first and second slider members adapted to fix longitudinally opposite ends of the belt in dimension-adjustable manner or in dimension-unadjustable manner and having a surface destined to come in contact with the peripheral surface, a pair of supporting walls spaced from each other in an axial direction of the air cylinder and extending in parallel to each other and a rotor extending in parallel to the axial direction of the air cylinder and having a pair of shafts rotatably supported by the pair of supporting walls; and the coupler member having a rod-like portion extending orthogonally to the rotor wherein the rod-like portion comprises one end fixed to the rotor of the first slider member so as to be not rotatable in a peripheral direction of the rod-like portion, a segment extending from the one end toward the second slider member and slidably penetrating through the rotor of the second slider member in a longitudinal direction of the rod-like portion, a control knob screwed on a threaded part extending outward from the rotor so that the control knob can move in the longitudinal direction of the rod-like portion and a spring interposed between the rotor of the second slider member and the control knob to bias the control knob to be spaced from the rotor.

According to one preferred embodiment of the invention, the one end of said rod-like portion constituting the coupler member penetrates through and projecting butward from the rotor of the first slider member in non-rotatable fashion and this projecting part is formed so as to prevent falling off of the one end from the rotor.

According to another preferred embodiment of the invention, the rod-like portion is formed with a female thread and the control knob is formed with a male thread.

According to still another preferred embodiment of the invention, each of the longitudinally opposite ends of the belt is length-adjustably put around a pair of supporting rods extending between the pair of supporting walls and each of the supporting rods presents a polygonal cross section.

Particularly concerning the first slider member and the second slider member adapted to fix the longitudinally opposite ends of the belt, according to the present invention, the control knob screwed on the second end of the coupler member may be rotated against the force of the spring means to move the second slider member close to the first slider member in the circumferential direction of the air cylinder and thereby to tighten the belt put around the air cylinder. In the case of this fastening device, the belt can be tightened or slackened merely by rotating the control knob screwed on the rod-like portion of the coupler member. Therefore, a structure of the movable part in this device can be sufficiently simplified to ensure that the movable part operates substantially without being affected by the impurities such as dust possibly contained in the supplied air.

According to one preferred embodiment of the invention, the rod-like portion of the coupler member is adapted to penetrate through the respective rotors of the first and second slider members and assembly as well as disassembly of the air cylinder fastening device is correspondingly facilitated.

According to another preferred embodiment of the invention, the male thread of the control knob is screwed on the female thread of the rod-like portion, so operation of the control knob is substantially free from affection of the impurities such as dust.

According to still another preferred embodiment of the invention, it is not apprehended that the belt put around the pair of supporting rods might be unintentionally slackened because each of the supporting rods presents the polygonal cross section which is effective to make rotation of the supporting rod difficult.

DETAILED DESCRIPTION OF THE PREFERRED EMBODIMENTS

Details of an air cylinder fastening device according to the present invention will be more fully understood from the description given hereunder with reference to the accompanying drawings.

Figure 1:
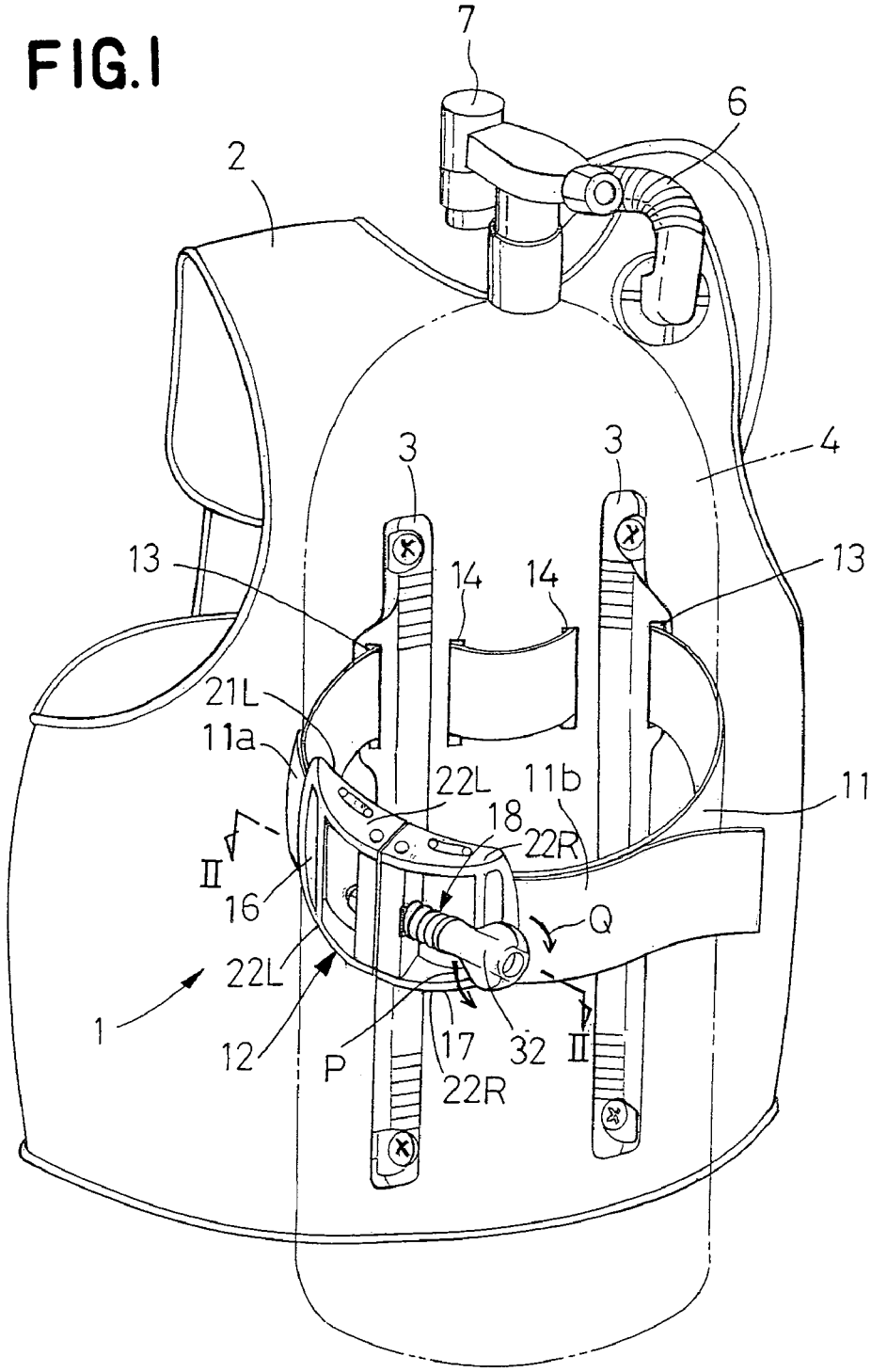
FIG. 1 is a perspective view showing an air cylinder fastening device as being actually used.

FIG. 1 is a perspective view showing an air cylinder fastening device 1 as being actually used. A fastening device 1 is used to fasten the air cylinder 4 indicated by an imaginary line to a harness 3 which is integral with a buoyancy compensating jacket 2 worn by a diver (not shown). The jacket 2 has various means such as a hose 6 through which the air is supplied from the air cylinder 4 and a pressure reducing valve 7 attached to the air cylinder 4. While the hose 6 is illustrated to be attached to the right shoulder of the jacket 2, it is also possible to attach the hose 6 to the left shoulder of the jacket 2.

The fastening device 1 includes a belt 11 destined to be put around the air cylinder 4 and tightening means 12 adapted to tighten the belt 11. The belt 11 has a first end 11*a* and a second end 11*b* and is successively guided through belt guide slits 13, 14 to be put around the air cylinder 4. The tightening means 12 comprise a first slider member 16, a second slider member 17 and a coupler member 18. A control knob 32 of the coupler member 18 may be rotated clockwise as indicated by an arrow Q to ensure that the first slider member 16 adapted to fasten the first end 11*a* of the belt 11 and the second slider member 17 adapted to fasten the second end 11*b* of the belt 11 get nearer to each other in a circumferential direction of the air cylinder 4. In this way, the belt 11 is tightened. The control knob 32 may be rotated counterclockwise as indicated by an arrow P to ensure that the first slider member 16 and the second slider member 17 are spaced from each other in the circumferential direction of the air cylinder 4 and consequently the belt 11 is slackened.

Figure 2:
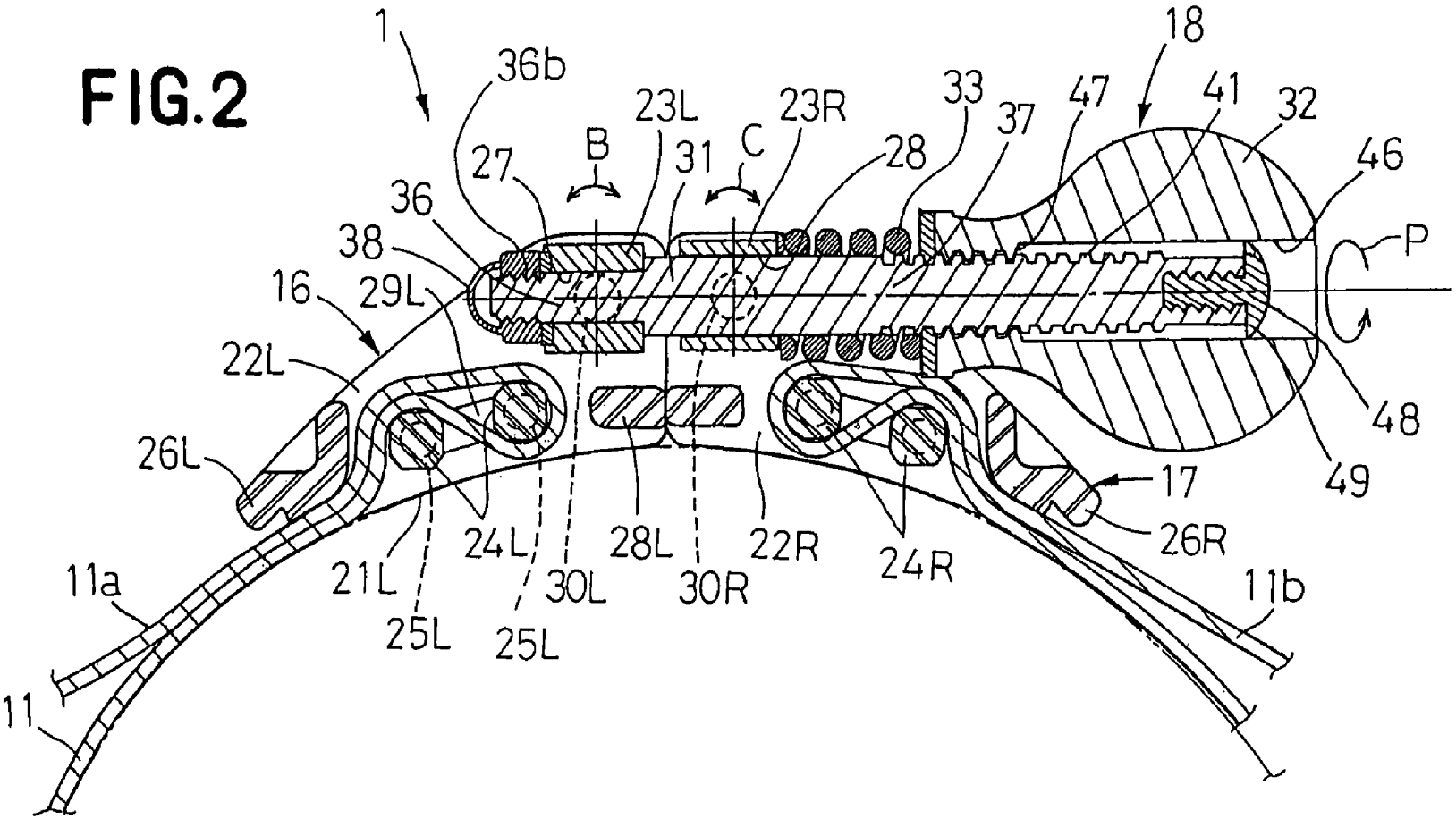
FIG. 2 is a sectional view taken along the line II—II in FIG. 1.

FIG. 2 is a sectional view taken along the line II—II in FIG. 1, showing the first slider member 16 and the second slider member 17 having moved closer to each other substantially in contact with each other.

Figure 3:
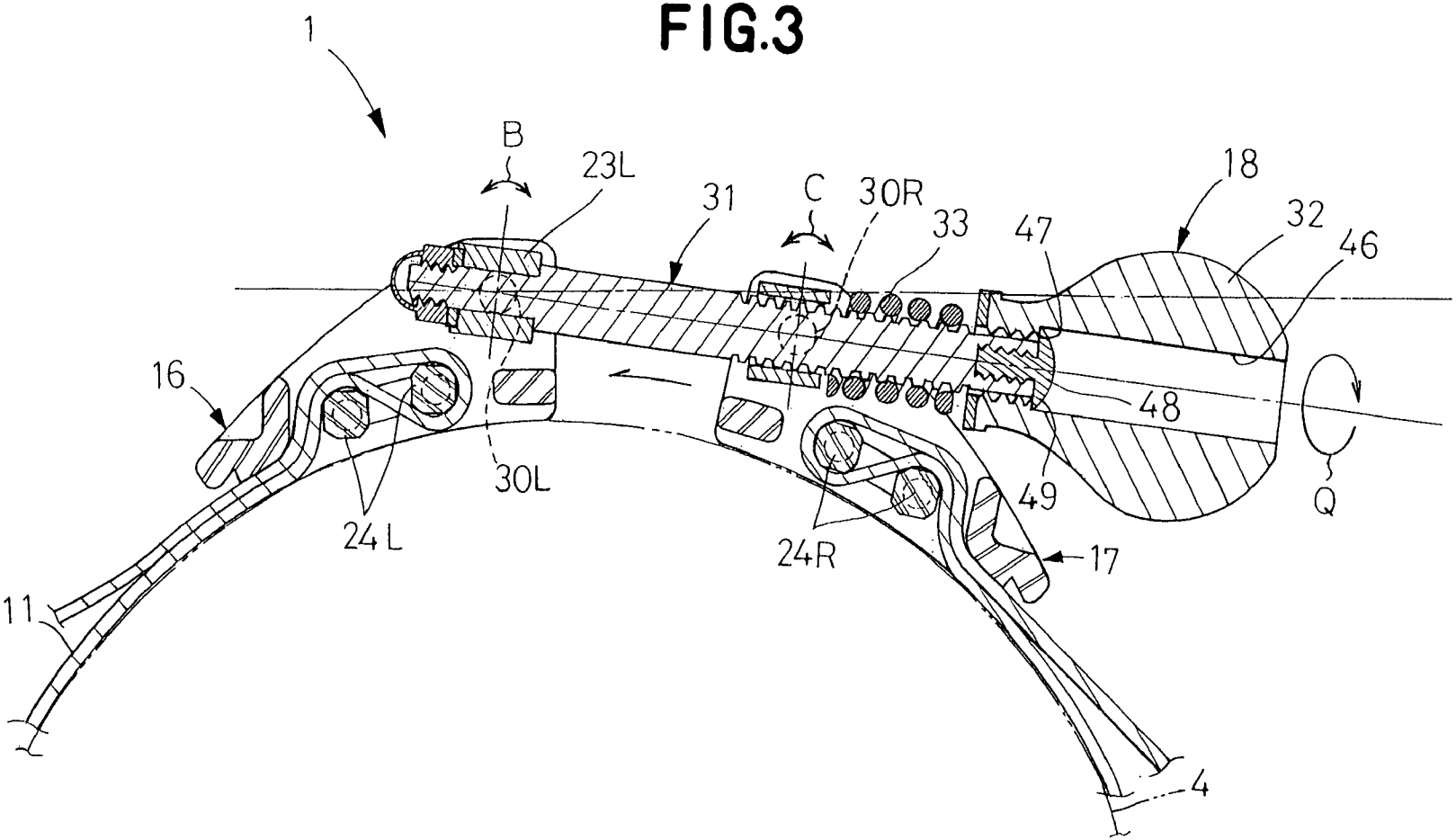
FIG. 3 is a view similar to FIG. 2 showing first and second sliders spaced from each other.

FIG. 3 is a view similar to FIG. 2, showing the first slider member 16 and the second slider member 17 having been spaced from each other.

Referring to FIG. 2, the first slider member 16 and the second slider member 17 are formed in a bilaterally symmetrical relationship except a part as will be described later and a description given herein with respect to the first slider member 16 is applicable to the second slider member 17 unless otherwise noted. Therefore, respective elements of these first and second slider members 16, 17 which are similar one to another are designated by similar reference numerals ending in L for the first slider member 16 and in R for the second slider member 17. In FIG. 2 illustrating the respective elements designated in this manner, the first slider member 16 comprises a contact surface 21L which is in close contact with and slidably movable on the peripheral surface of the air cylinder 4 in its circumferential direction, a pair of supporting walls 22L (See FIG. 1) extending in parallel to each other and spaced from each other in a direction defined by a central axis (not shown) of the air cylinder 4, a rotor 23L extending in parallel to the central axis between the pair of supporting walls 22L, a pair of supporting rods 24La, a first coupler member 26L and a second coupler member 28L both serving also belt tensioners. The rotor 23L has integrally therewith a columnar shaft 30L indicated by chain lines in FIG. 2 (See FIG. 4 also) which is supported by the supporting walls 22L so that the columnar shaft 30L can be rotated together with the rotor 23L in directions indicated by a double-headed arrow B. The rotor 23L is formed in its intermediate portion between the supporting walls 22L with a through-hole 27 presenting a rectangular cross section (See FIG. 4). Each of the supporting rods 24L presents a circular cross section in each of its longitudinally opposite ends 25L as indicated by chain lines. In an intermediate portion defined between the longitudinally opposite ends 25L and around which the belt 11 is length-adjustably put, each of the supporting rods 24L presents a circular, more preferably, a polygonal cross section (octagonal cross section in the illustrated embodiment). The longitudinally opposite ends 25L of the supporting rod 24L are engaged with slots 29L of the respective supporting walls 22L extending in the circumferential direction of the air cylinder 4 so that these ends 25L can slide along the respective slots 29L. The first and second coupler members 26L, 28L respectively have longitudinally opposite ends fixed to the pair of supporting walls 22L so as to couple these supporting walls 22L to each other.

The second slider member 17 has a rotor 23R which is similar to the rotor 23L of the first slider member 16 so far as the configuration is concerned. The rotor 23R is distinguished from the rotor 23L in that the rotor 23R is rotatable together with its cylindrical shafts 30R in directions indicated by a double-headed arrow C and its intermediate portion defined between a pair of supporting walls 22R is formed with a second through-hole 28 presenting a circular cross section.

The first end 11*a* of the belt 11 is folded back around one of the supporting rods 24L and guided along the other supporting rod 24L as illustrated, each of these supporting rods 24L having the octagonal cross section, so that upper and lower sections of the end 11*a* placed upon each other are pressed together by the first coupler member 26L against the peripheral surface of the air cylinder 4. The first end 11*a* is squeezed between the pair of supporting rods 24L and pressed by the first coupler member 26L, so the belt 11, if this is in tightened state, can be reliably prevented from being slackened relative to the first slider member 16 and/or deflecting from this first slider member 16. The second end 11*b* of the belt 11 also is folded back around one of the supporting rods 24R and guided along the other supporting rod 24R, so that upper and lower sections of the end 11*b* placed upon each other are pressed together by the first coupler member 26R against the peripheral surface of the air cylinder 4. The second end 11*b* is pressed by the first coupler member 26L, so the belt 11, if this is in tightened state, can be reliably prevented from being slackened relative to the second slider member 17 and/or deflecting from this second slider member 17.

The coupler member 18 comprises a rod-like portion 31, a control knob 32 and a coil spring 33. The rod-like portion 31 has a front segment 36 fixed to the rotor 23L and a rear segment 37 extending from the rotor 23L toward the second slider member 17. The front segment 36 extends through the first through-hole 27 from the right hand as viewed in FIG. 4 and a first threaded part 36*b* of this front segment 36 extends outward from the first through-hole 27. A hexagon cap nut 38 is detachably screwed on the first threaded part 36*b* in order to prevent falling off of the first threaded part 36*b* from the first through-hole 27 (See FIG. 4). The rear segment 37 bears against the rotor 23L in the vicinity of the peripheral edge of the first through-hole 27. The rear segment 37 slidably extends through the second through-hole 28 of the rotor 23R in the second slider member 17 in a longitudinal direction of the rod-like portion 31 and includes a second threaded part 41 formed with a female thread and extending further rightward as illustrated. A control knob 32 formed with a male thread is screwed on the second threaded part 41 and a coil spring 33 is interposed between the knob 32 and the rotor 23R of the second slider member 17. With the belt 11 being in tightened state as illustrated, the spring 33 is in its compressed state and biases the knob 32 to be spaced from the rotor 23R.

FIG. 3 is a view similar to FIG. 2 showing the knob 32 having been rotated counterclockwise as indicated by the arrow P. Rotation of the knob 32 counterclockwise as indicated by the arrow P causes this knob 32 to move rightward as viewed in FIG. 2 until a peripheral edge 49 of a screw bolt 48 screwed in the right end of the rod-like portion 31 bears against a step 47 formed in a through-hole 46 axially extending through the knob 32. Thereupon, the spring 33 released from its compressed state can be spaced from the rotor 23R sufficiently to ensure that the second slider member 17 is guided by the rod-like portion 31 to be moved from the position shown in FIG. 2 to the position shown in FIG. 3 along the peripheral surface of the air cylinder 4. During such movement of the second slider member 17, the rotor 23L of the first slider member 16 is rotatable around its longitudinally opposite shafts 30L in the directions indicated by the double-headed arrow B while the rotor 23R of the second slider member 17 is rotatable around its longitudinally opposite shafts 30R in the directions indicated by the double-headed arrow C. Therefore, it is not apprehended that the rod-like portion 31 linearly extending between the first and second slider members 16, 17 might obstruct movement of the second slider member 17 along the peripheral surface of the air cylinder 4.

Once the second slider member 17 has moved to the position shown in FIG. 3, the belt 11 is in slackened state and it is now possible to release the air cylinder 4 from the harness by further slackening the belt 11 around the supporting rods 24L, 24R. To tighten the belt 11 again, on the contrary, the knob 32 may be clockwise rotated as indicated by the arrow Q from the position shown in FIG. 3 and thereby the second slider member 17 may be moved close to the first slider member 16. Relative position of the first slider member 16 and the second slider member 17 depends on a predetermined segment length of the belt 11 defined between the first and second slider members 16, 17. FIG. 2 exemplarily shows the relative position of the first and second slider members 16, 17 assuring a desired tightness of the belt 11.

Figure 4:
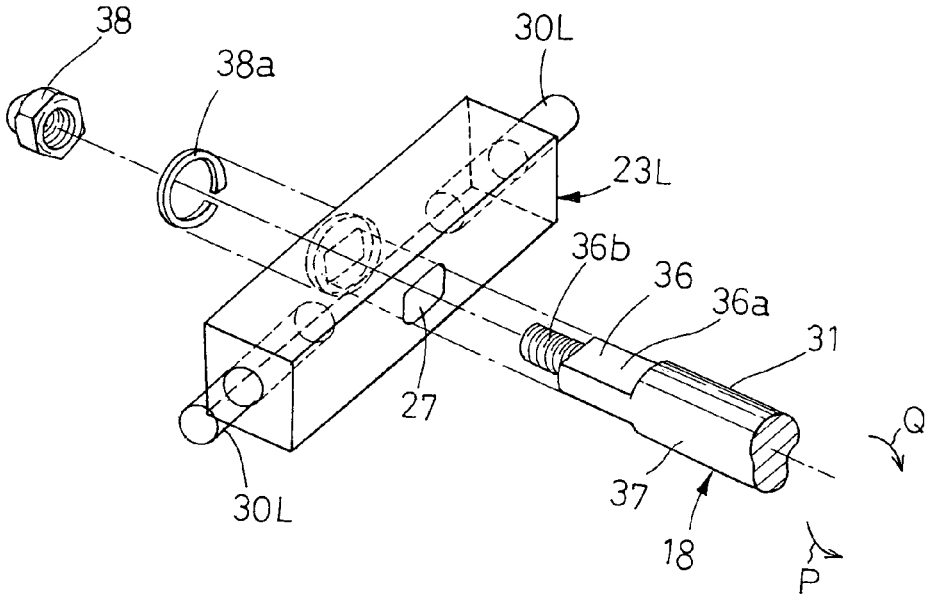
FIG. 4 is a partial exploded view of a rotor and a coupler member.

FIG. 4 is a partial exploded perspective view of the rotor 23L and the coupler member 18. The rotor 23L has the longitudinally opposite cylindrical shafts 30L and is formed in the intermediate portion between these shafts 30L, 30L with the first through-hole 27. The first through-hole 27 presents a rectangular cross section and the front segment 36 of the coupler member 18 has a part presenting a rectangular cross section press-fitted into the first through-hole 27. The threaded part 36*b* of the front segment 36 extends through the through-hole 27 and further extends leftward as viewed in FIG. 4 from the through-hole 27 and is provided with the hexagon cap nut 38 screwed thereon. A spring washer 38*a* is interposed between the hexagon cap nut 38 and the rotor 23L. The shafts 30L of the rotor 23L are rotatably received in bearing holes (not shown) formed in the pair of supporting walls 22L, respectively. The rod-like portion 31 of the coupler member 18 mounted on the rotor 23L in this manner is not rotated even when the knob 32 screwed on this rod-like portion 31 is rotated counterclockwise as indicated by the arrow P or clockwise as indicated by the arrow Q.

In the fastening device 1 arranged as has been described above, a structure around which the belt 11 is put is sufficiently simplified to miniaturize the device 1. The belt 11 can be tightened merely by rotating the control knob 32 and no significant force is required for this purpose. The control knob 32 and the second threaded part 41 use the male thread and the female thread, respectively, so operation of the control knob 32 is free from affection of the impurities such as dust as the prior art using the worm gear train has been the case. While it is possible to fix the front segment 36 of the rod-like portion 31 constituting the coupler member 18 to the rotor 23L of the first slider member 21 by means of welding or the like, screwing of the hexagon cap nut or the like is preferable for this purpose since disassembly and assembly of the fastening device 1 is thereby more facilitated.

Figure 5:
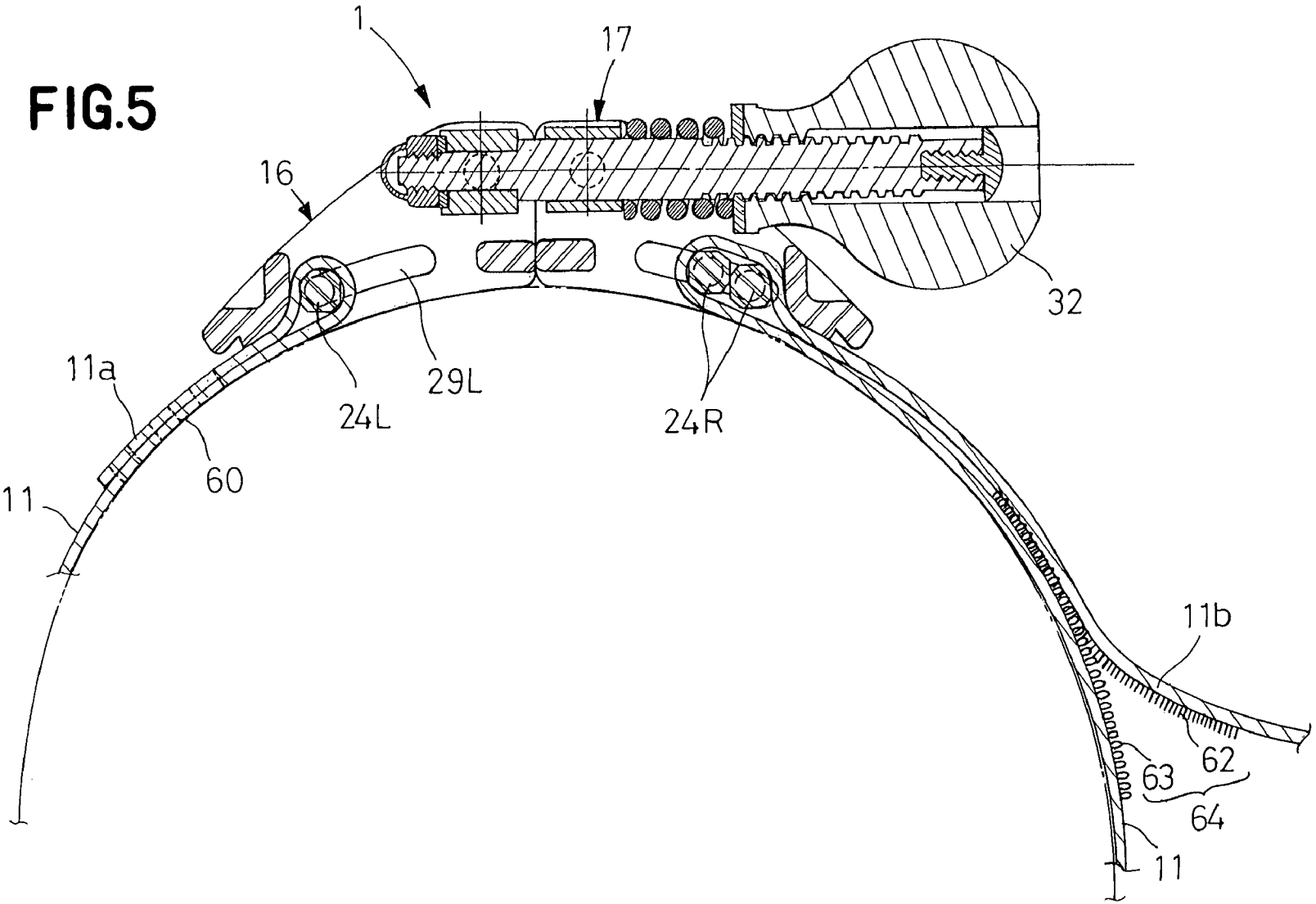
FIG. 5 is a view similar to FIG. 2 showing one preferred embodiment.

FIG. 5 is a view similar to FIG. 2 showing one preferred embodiment of the present invention. In the first slider member 16 of this fastening device 1 illustrated herein, the first end 11*a* of the belt 11 put around the single supporting rod 24L and folded back is stitched with the section of the belt 11 placed upon the first end 11*a* with thread 60 so that the first end 11*a* is fixed to the first slider member 16 in length-unadjustable manner. However, the supporting rod 24L is slidable in the slot 29L along the length of this slot 29L. In the second slider member 17, the second end 11*b* put around the pair of supporting rods 24R and folded back is releasably engaged with the section of the belt 11 placed upon the second end 11*b* by means of a mechanical fastener 64 comprising hook members 62 and loop members 63. The hook members 62 are attached to the second end 11*b* and the loop members 63 are attached to the section of the belt 11 placed upon the second end 11*b*. In the case of such fastening device 1, the belt 11 put around the air cylinder 4 is previously maintained under a low tension by means of the mechanical fastener 64 after the second end 11*b* has been appropriately pulled and then the control knob 32 is clockwise rotated in the direction Q until the second slider member 17 gets nearer to the first slider member 16 so that the belt 11 may be put under a desired high tension. The pair of supporting rods 24R of the second slider member 17 adapted to get nearer to each other respectively have polygonal cross sections like those in the embodiment illustrated by FIG. 2 and therefore rotation of these supporting rods 24R relative to each other is prevented after they have been brought in contact with each other. Consequently, there is no anxiety that the belt 11 put around these supporting rods 24R under a tension might be unintentionally slackened.

The present invention allows a miniaturized fastening device for the air cylinder free from trouble due to the impurities such as dust contained in the supplied air.

What is claimed is:

1. An air cylinder fastening device comprising:

a belt adapted for releasably fastening said air cylinder to a harness used to carry the air cylinder on a user's back and tightening means for said belt;

said tightening means comprising first and second slider members opposed to each other on a peripheral surface of said air cylinder as viewed in a circumferential direction of said air cylinder and being slidable in said circumferential direction and a coupler member extending between said first and second slider members and adapted to bring the first and second slider members nearer to each other of further apart from each other;

each of said first and second slider members adapted to fix longitudinally opposite ends of said belt in a length-adjustable or a length-unadjustable manner and having a surface destined to come in contact with said peripheral surface, a pair of supporting walls spaced from each other in an axial direction of said air cylinder and extending in parallel to each other and a rotor extending in parallel to said axial direction of said air cylinder and having a pair of shafts rotatably supported by said pair of supporting walls; and said coupler member having a rod-like portion extending orthogonally to said rotor wherein said rod-like portion comprises one end fixed to said rotor of said first slider member so as to be not rotatable in a peripheral direction of said rod-like portion, a segment extending from said one end toward said second slider member and slidably penetrating through said rotor of said second slider member in a longitudinal direction of said rod-like portion, a control knob screwed on a threaded part extending outward from said rotor so that said control knob can move in the longitudinal direction of said rod-like portion and a spring interposed between said rotor of said second slider member and said control knob to bias said control knob to be spaced from said rotor.

2. The air cylinder fastening device according to claim 1, wherein said one end of said rod-like portion constituting said coupler member penetrates through and projecting outward from said rotor of said first slider member in non-rotatable fashion and this projecting part is formed so as to prevent falling off of said one end from said rotor.

3. The air cylinder fastening device according to claim 1, wherein said rod-like portion is formed with a female thread and said control knob is formed with a male thread.

4. The air cylinder fastening device according to claim 1, wherein each of the longitudinally opposite ends of said belt is length-adjustably put around a pair of supporting rods extending between said pair of supporting walls and each of said supporting rods presents a polygonal cross section.

* * * * *